US005947069A

United States Patent [19]

Koerner

[11] Patent Number: 5,947,069

[45] **Date of Patent: *Sep. 7, 1999**

[54] ROLLER TYPE MECHANICAL TAPPET

[76] Inventor: Jeffrey Scott Koerner, 7759 E. Almond, Tuscon, Ariz. 85730

[ * ] Notice: This patent is subject to a terminal disclaimer.

[21] Appl. No.: 09/231,003

[22] Filed: Jan. 14, 1999

Related U.S. Application Data

[63] Continuation of application No. 08/959,573, Oct. 28, 1997, Pat. No. 5,860,398.

[51] Int. Cl.[6] ..... F01L 1/16

[52] U.S. Cl. ..... 123/90.48; 29/888.43

[58] Field of Search ..... 123/90.48; 29/888.43

[56] References Cited

U.S. PATENT DOCUMENTS

| | | | |
|---|---|---|---|
| 1,473,711 | 11/1923 | Sherbondy | 123/90.51 |
| 1,840,633 | 1/1932 | Morehouse | 184/6.9 |
| 1,930,261 | 10/1933 | Berry | 123/90.5 |
| 3,303,833 | 2/1967 | Melling | 123/90.48 |
| 3,450,228 | 6/1969 | Worthman et al. | 184/6.9 |
| 5,188,067 | 2/1993 | Fontichiaro | 123/90.18 |

OTHER PUBLICATIONS

"*Automotive Mechanics*" (10th Ed.) by William H. Crouse and Donald L. Anglin, McGraw–Hill (1993), Chapter 12, pp. 125–137, and Chapter 14, pp. 159–173.

"*Power Secrets*" by Smokey Yunick and Larry Schreib, S–A Design Books (1989), Chapter 5, pp. 68–94.

*Primary Examiner*—Noah P. Kamen

*Attorney, Agent, or Firm*—Steven G. Lisa

[57] ABSTRACT

A tappet comprises a foot having a convex cam contact surface and an axially extending hub, a tappet body having a lower body portion with a lower axial bore formed therein to receive the axially extended hub of the foot, and a bearing assembly positioned between the foot and the lower portion of the tappet body. The cam contact surface operates in a frictional relationship with a cam lobe of a rotating cam. The frictional relationship between the cam lobe and the cam contact surface of the foot induces the foot to rotate about the center line of the tappet. The bearing assembly operates to reduce friction as the foot independently rotates axially about a center line of the tappet body.

21 Claims, 7 Drawing Sheets

ROLLER TYPE MECHANICAL TAPPET

This application is a continuation of application Ser. No. 08/959,573, filed Oct. 28, 1997, now U.S. Pat. No. 5,860, 398.

FIELD OF INVENTION

This invention relates to engine tappets or lifters, and more specifically, to new forms of mechanical tappets including roller ends.

BACKGROUND OF INVENTION

The tappet in an internal combustion engine is a well-known device, and is also commonly referred to as a lifter, valve lifter, or tappet. For examples of common forms of tappets, see William H. Crouse and Donald L. Anglin's *Automotive Mechanics* (McGraw-Hill 10th Edition), ISBN 0-02-800943-6 at pp. 131, and 169–170 and Smokey Yunick's and Larry Schrieb's *Power Secrets* (S-A Design Books 1989) ISBN 0-931472-06-7 at pp. 76–80, both of which are incorporated herein by reference.

FIG. 1 depicts a typical tappet application for a push rod engine. In general, a lifter or tappet interacts directly with a rotating cam shaft in the engine's valve train. That interaction begins the chain of events that converts the rotary motion of the camshaft into the reciprocating motion of the engine's intake and exhaust valves. The amount of horsepower generated by an engine is related to how efficiently the valve train operates. Indeed, it is common knowledge that, of all the adjustments that can be made to an internal combustion engine, adjustments to the valve train have the greatest impact on increasing horsepower.

In general, the more efficiently air enters and combusted gas exits an engine, as controlled by the opening and closing of the intake and exhaust valves, the more horsepower the engine will produce. "Lifting," or opening the valves as high and as fast as possible, and closing the valves as fast as possible, are necessary to obtain efficient air and gas flow, and to achieve optimum horsepower. "High lift" is generally obtained by designing a camshaft having aggressive cam lobes with steep flank angles. Consequently, in high-performance applications, a tappet must be able to reliably negotiate the contour of an aggressive cam lobe at extremely high rpm's. In addition, the tappet must be durable and capable of withstanding extreme frictional forces and high valve spring pressures.

Push rod-type internal combustion engines typically use one of four types of tappets or lifters: the flat mechanical tappet, the msuhroom tappet, the roller tappet, or the hydraulic tappet. Each of these types of tappets or lifters is discussed briefly below.

The single piece, flat mechanical tappet is inexpensive, simple to produce, and reliable in stock environments, and has been the industry standard for years. In high performance applications, however, the flat mechanical tappet has several limitations. First, the flat mechanical tappet requires an extensive and detailed break-in procedure. The break-in procedure typically includes: (1) polishing the lifter foot without disturbing the contour of its convex foot; (2) coating the camshaft lobes with a high performance lubricant; (3) preheating the engine oil before starting the engine, (4) installing light weight valve springs; (5) starting and running the engine for about thirty minutes at about 2500 rpm's to ensure that adequate oil circulation is present in the valve train, and that the tappets are broken in slowly; (6) after shutting down the engine, installing the proper valve springs. This tedious process is necessary to obtain optimum performance from both the tappets and camshaft. Second, mechanical tappets do not work well in high performance applications using aggressive camshafts characterized by lobes having steep opening and closing flanks.

The "mushroom tappet" was developed in an effort to address some of the limitations of the standard mechanical tappet, particularly for use with aggressive cam shaft designs. The mushroom tappet uses a foot with a larger diameter than the body of the tappet, which allows it to more easily negotiate the steeper flank angles of aggressively designed cam lobes. However, several drawbacks are also associated with mushroom tappets. First, before a mushroom tappet can be used, the engine block must usually be machined to ensure adequate clearance with the enlarged tappet foot. Second, the enlarged mushroom tappet foot requires that the tappet be inserted and removed from the bottom of the engine block, thereby complicating repairs or maintenance on the valve train. Third, even the mushroom tappet is characterized by relatively high friction rates requiring significant lubrication.

Moreover, all mechanical tappets are designed to rotate in their bore. The rotation is induced when the convex surface of the lifter foot is in contact the tapered, rotating, cam lobe. The rotation of the lifter or tappet in its bore is necessary to avoid prematurely wearing the lifter foot and cam lobe. However, several additional disadvantages are associated with tappet rotation. First, as the lifter rotates, considerable friction is generated between the surface area of the inside diameter of the lifter bore and the surface area of the outside diameter of the lifter body. Thus, mechanical tappets have relatively high friction rates that often require extensive modifications to the engine to increase the oil flow to the cam lobes and upper valve train in high-performance applications. Secondly, because mechanical tappets rotate, the use of "Rev Kits" (discussed below) has not been successful. Third, because the entire mechanical lifter rotates, it is not possible to use an offset push rod cup, which is often needed to gain additional push rod/cylinder head clearance in some applications. More specifically, offset pushrod cups are typically used in applications where the intake ports of the engine block have been bored to a larger size thus sometimes creating a less than zero clearance between teh push-rod and engine block.

To reduce the adverse effects of friction between the tappet foot and cam lobe, it is highly desirable to make mechanical tappets that are both light and strong, thereby reducing friction. However, the tappet must still be strong enough to withstand the extreme pressures exerted from the valve springs and cam lobe, and durable enough to withstand the rotational forces between the cam lobe and cam foot. As a result, many types of light-weight, exotic, and expensive materials have been used to fabricate tappets. The optimum solution is one that would be able to utilize two different metals in the lifter. This would make it possible to use one type of metal for the lifter body, and one type for the lifter foot. However, the typical one piece design of a mechanical tappet dictates using the same material for the entire lifter body.

The "roller tappet" was developed in large part to overcome the many disadvantages of the mechanical tappet. Roller tappets reduce friction between the cam lobe and lifter foot, thereby reducing lubrication requirements. Thus, roller tappets are desirable in high performance applications, as they can maintain valve train stability at high rpm's and aggressive cam shaft designs. However, they likewise have several drawbacks.

First, many racing circuits do not allow the use of roller tappets. For example, one of the world's largest racing circuits, the Winston Cup Series, prohibits the use of roller tappets. Second, to achieve optimum performance with roller tappets, it is necessary to install an anti rotational device and Rev Kit, thereby further increasing the number of valve-train components, as well as the likelihood of failure. If failure occurs in a roller tappet, typically the results are instantly fatal to the engine.

A fourth common form of lifter is a hydraulic lifter. Hydraulic lifters have several advantages over both mechanical lifters and roller lifters. Hydraulic lifters automatically compensate for any clearance changes caused by temperature variation or wear. Thus, they should never need adjustment. Also because there is no clearance between the lifter foot and the cam lobe, hydraulic lifters are extremely quiet while in operation when compared to both mechanical or solid lifters. Mechanical or roller lifters need to have some clearance or "lash" between the lifter foot and the cam lobe to act as a cushion to allow for any tolerance changes due to thermal expansion or contraction encountered during repeated engine cycles.

However, hydraulic lifters also have some undesirable qualities. Hydraulic lifters are only as reliable as the cleanliness of the engine oil. Thus, if any dirt is present in the oil, the lifter will not compress or decompress properly, and valve and camshaft damage would soon result. Hydraulic lifters also do not work well at high rpm's, because the lifters have a tendency to "pump up" as the rpm's increase. In other words, as engine rpm's increase, more oil is introduced into the oil chamber, preventing the lifter from compressing and decompressing, and adversely impacting the stability of the valve train. The result, is a loss of compression and horse power because the valves are held off their seats.

Thus, the need exists for a new form of lifter or tappet that combines the many advantages of the different types of lifters or tappets with little or none of their varied disadvantages. Thus, a need exists for a multiple piece, roller-type mechanical tappet for use in high performance applications and that is effective, reliable, and inexpensive to produce.

SUMMARY OF THE INVENTION

It is an object of this invention to overcome many problems typically associated with prior art valve train designs.

It is an object of this invention to provide a tappet device that reduces friction between the tappet foot and the lobe of the cam shaft.

It is an object of this invention to provide a multi-piece lifter or tappet having one end that rotates on the face of the cam.

It is an object of this invention to provide a lifter or tappet that is both durable and reliable.

It is an object of this invention to provide a lifter or tappet comprising interchangeable components.

It is an object of this invention to provide a mechanical tappet with interchangeable tappet feet to adapt to a variety of cam shaft materials and designs.

It is an object of this invention to provide a mechanical tappet with interchangeable push rod receiver cups.

It is an object of this invention to provide a mechanical tappet with interchangeable receiver cups of different thicknesses, and that can be changed to change overall push rod lengths.

It is an object of this invention to provide a mechanical tappet having a light-weight body section, and a hardened base section capable of enduring substantial frictional forces.

It is an object of this invention to provide a mechanical tappet that can be used effectively with camshafts having steep opening and closing flank angles.

It is an object of this invention to provide a mechanical tappet that is cost effective to produce.

It is an object of this invention to provide a mechanical tappet that will increase engine horsepower.

It is an object of this invention to provide a mechanical tappet that requires little, or no, break-in time.

It is an object of this invention to provide a mechanical tappet that is easily adapted to a rev kit by linking consecutive pairs of tappets.

It is an object of this invention to provide a mechanical tappet including a lubrication system that supplies increased lubrication to the valves and valve springs.

It is an object of this invention to provide a mechanical tappet including a lubrication system that supplies increased lubrication to the cam lobes of the cam shaft.

It is an object of this invention to decrease operating engine oil temperatures by increasing tappet performance and lubrication, while reducing valve train friction.

It is an object of this invention to provide a mechanical tappet that can be used in all major racing classes.

It is an object of this invention to provide a mechanical tappet that is easy to install, remove and break-in.

It is an object of this invention to be able to provide a mechanical tappet able to endure substantial valve spring pressures.

It is an object of this invention to be able to be adapted for use with a hydraulic tappet.

It is an object of this invention to be able to be adapted for use with an overhead direct acting bucket tappet.

The above and other objects are achieved by a tappet comprising a foot having a convex cam contact surface and an axially extending hub, a tappet body having a lower body portion with a lower axial bore formed therein to receive the axially extended hub of the foot, and a bearing assembly positioned between the foot and the lower portion of the tappet body. The cam contact surface operates in a frictional relationship with a cam lobe of a rotating cam. The frictional relationship between the cam lobe and the cam contact surface of the foot induces the foot to rotate about the center line of the tappet. The bearing assembly operates to reduce friction as the foot independently rotates axially about a center line of the tappet body.

The foot is removable from the lower bore in the tappet body. The bearing assembly comprises a lower race, an upper race, and a needle bearing placed between the lower race and the upper race. The foot includes a top flat surface formed to support the lower bearing race, and the lower portion of the tappet body includes a lower flat surface formed to contact the upper bearing race. The foot can be formed with a profile that matches a corresponding profile of the cam with which it cooperates.

The tappet includes a replaceable push rod receiver cup assembly supported by a top portion of the tappet body. The top portion of the tappet body includes an upper axial bore and a support shelf formed within the bore, and the replaceable push rod receiver cup assembly is supported on the support shelf within the bore in the top portion of the tappet body. In a preferred form, the push rod receiver cup comprises a spacer and a mated receiver cup.

The tappet includes an oil delivery system forming an oil path leading from the tappet body to the convex cam contact surface of the foot. The oil delivery system includes an oil path leading from the tappet body to the convex cam contact surface and from the tappet body to the push rod receiver cup assembly. In one form, the oil delivery system includes an oil access orifice formed in the mid-section of the tappet body at a location selected to mate with a source of oil, wherein the orifice leads to an interior chamber of the tappet body. An oil orifice is also formed in the convex surface of the foot. A bore is formed in the center of the axially extending hub of the foot and serves as a channel between the interior chamber of the tappet body and the oil orifice in the convex surface of the foot. An oil channel is also formed in the spacer of the push-rod receiver cup assembly, and an oil orifice is formed in the base of the push rod receiver cup. Oil is received from a source in the motor, and is delivered to the oil orifices in the foot and replaceable push rod cup.

The preferred embodiments of the invention presented here are described below in the Figures and Detailed Description. Unless specifically noted, it is intended that the words and phrases in the specification and the claims are given the ordinary and accustomed meaning to those of ordinary skill in the applicable arts. If any other special meaning is intended for any word or phrase, the specification will clearly state and define the special meaning. For example, a tappet is also commonly referred to as a "lifter" and any reference to that term should be deemed equivalent and interchangeable throughout the specification.

Likewise, the use of the words "function" or "means" in the Detailed Description is not intended to indicate a desire to invoke the special provisions of 35 U.S.C. 112, Paragraph 6, to define the invention. To the contrary, if the provisions of 35 U.S.C. 112, Paragraph 6 are sought to be invoked to define the inventions, the claims will specifically state the phrases "means for" or "step for" and a function, without also reciting in such phrases any structure, material or act in support of the function. Even when the claims recite a "means for" or "step for" performing a function, if they also recite any structure, material or acts in support of that means or step, then the intention is not to invoke the provisions of 35 U.S.C. 112, Paragraph 6. Moreover, even if the provisions of 35 U.S.C. 112, Paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, material or acts for performing the claimed function.

BRIEF DESCRIPTION OF THE DRAWINGS

The characteristics and benefits of the present invention can be more easily understood from the following descriptions of the preferred embodiments in combination with the accompanying drawings.

DESCRIPTION OF THE PREFERRED EMBODIMENT

The purpose and operation of a tappet or lifter is well known in the art. A tappet is a device designed to work in direct relation with a rotating camshaft for the purpose of opening and closing intake and exhaust valves in an internal combustion engine. There are basically four types of tappets—mechanical, mushroom, hydraulic, and roller tappets. The present invention pertains primarily to a form of mechanical tappet in a uniquely modified form.

Figure 1:
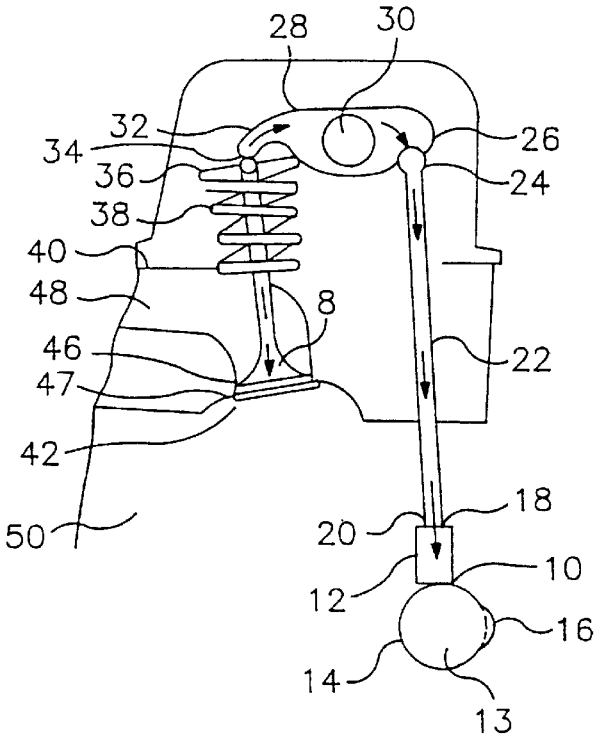
FIG. 1 is a perspective side view showing a typical tappet and cam application in a push rod engine in its ignition or compression cycle.

FIG. 1 is a partial side view representing a conventional tappet and cam arrangement with valve 8 in the closed position, indicating that the engine cylinder is in either the ignition or compression cycle. A foot 10 of tappet 12 is in direct contact with a foot 14 (sometimes referred to as heel) of a cam 13. The opposite end of the tappet body 12 contains a push rod receiver cup 18 that receives spherical end 20 of a push rod 22. The opposing spherical end 24 of push rod 22 is pivotally received into a receiver cup 26 of a rocker arm 28. The rocker arm 28 is mounted on a rocker arm shaft 30. The valve end 32 of the rocker arm 28 is in direct contact with a valve stem end 34. Located beneath the valve stem end 34 is a spring retainer 36 and a valve spring 38. The valve spring 38 is a compression spring and exerts constant pressure on cylinder head surface 40 and a spring retainer 36 when the valve is closed. A valve face 42 comprises machined chamfered radial edge that forms a positive seal 46 with a valve seat 47 of an intake/exhaust port 48. The valve head is a flat surface on the bottom of the valve and forms the top of a compression chamber 50. The valve 8 remains in the closed position as long as the cam foot 10 of tappet 12 is in contact with the cam foot portion 14 of cam 13, causing the valve spring 38 to exert force on the spring retainer 36, causing the entire valve train assembly to shift in the direction of the arrows, thus holding the valve 8 in the closed position.

Figure 2:
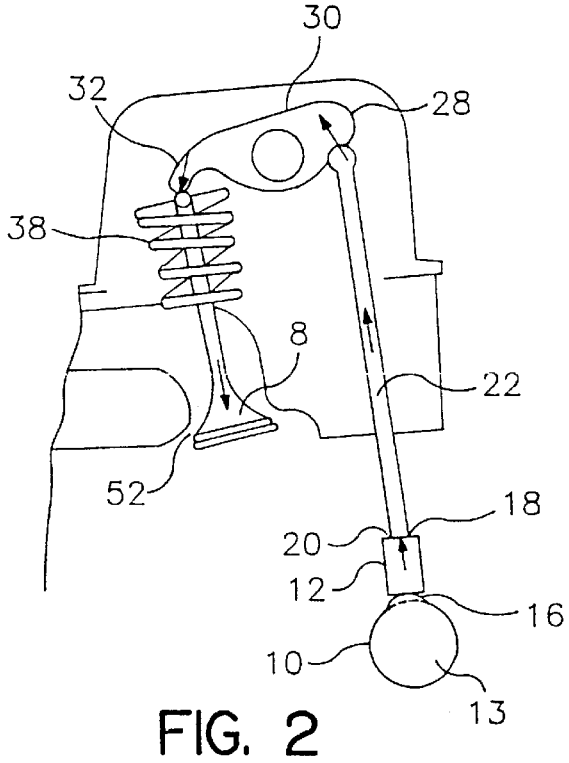
FIG. 2 is a perspective side view showing a typical tappet and cam application in a push rod engine in its intake or exhaust cycle.

FIG. 2 depicts valve 8 in an open position, which occurs during the intake or exhaust cycle of the cylinder. Cam 13 rotates until the raised cam lobe 16 is positioned under cam foot 10 of tappet 12. The lobe 16 lifts the tappet 12 upward, forcing the push rod 22 to cause the rocker arm 28 to pivot on rocker arm shaft 30. The valve end 32 of rocker arm 28 presses against valve stem top 34, causing valve spring 38 to compress and the valve 8 to open, as illustrated by the direction of the arrows.

FIGS. 1 and 2 collectively illustrate the basic operation of the valve train of a push rod internal combustion engine, including the manner in which the valves open and close. The opening and closing process perpetuates itself as long as fuel, spark, and air are supplied to the combustion chamber. This process is fundamental to the operation of an internal combustion engine.

Figure 3:
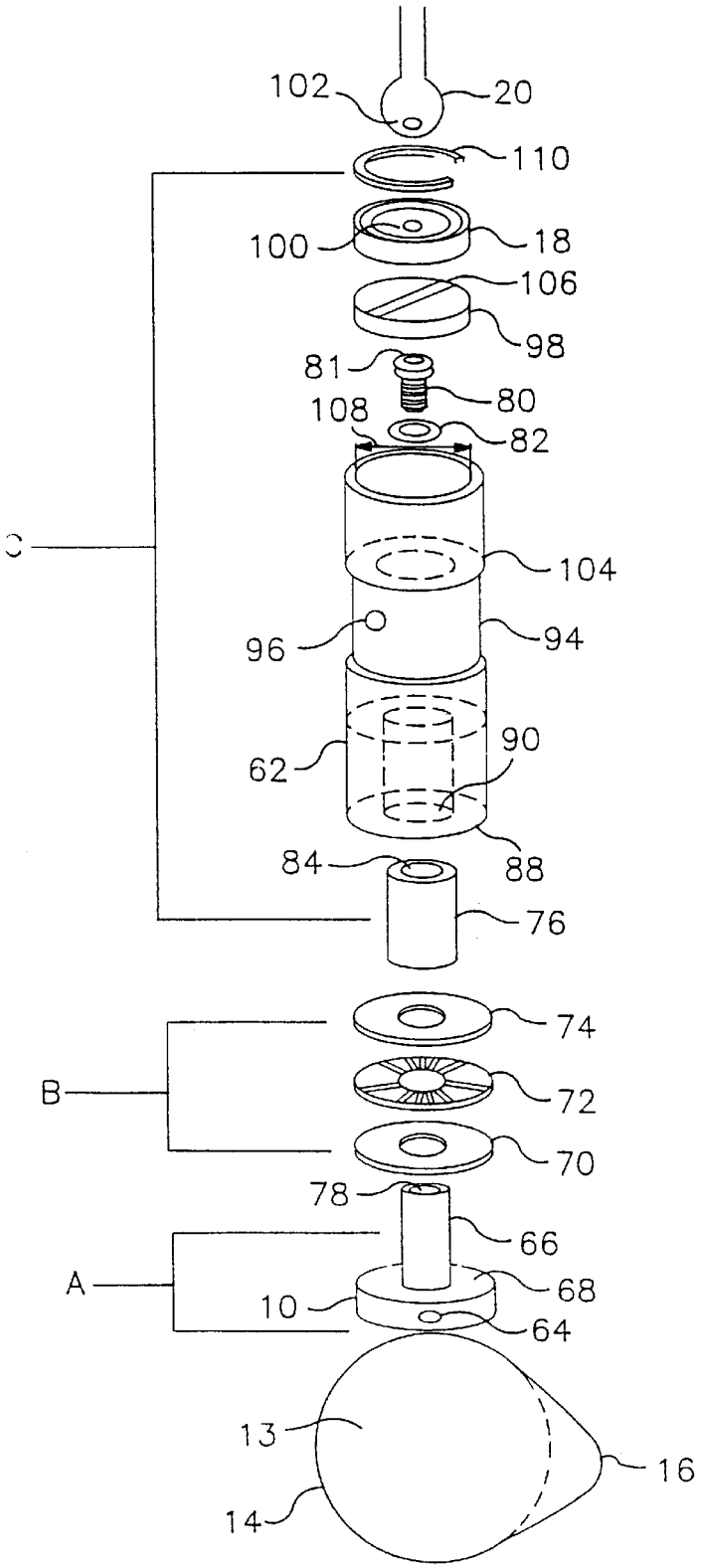
FIG. 3 is an exploded view of a preferred embodiment of the invention.
Figure 4:
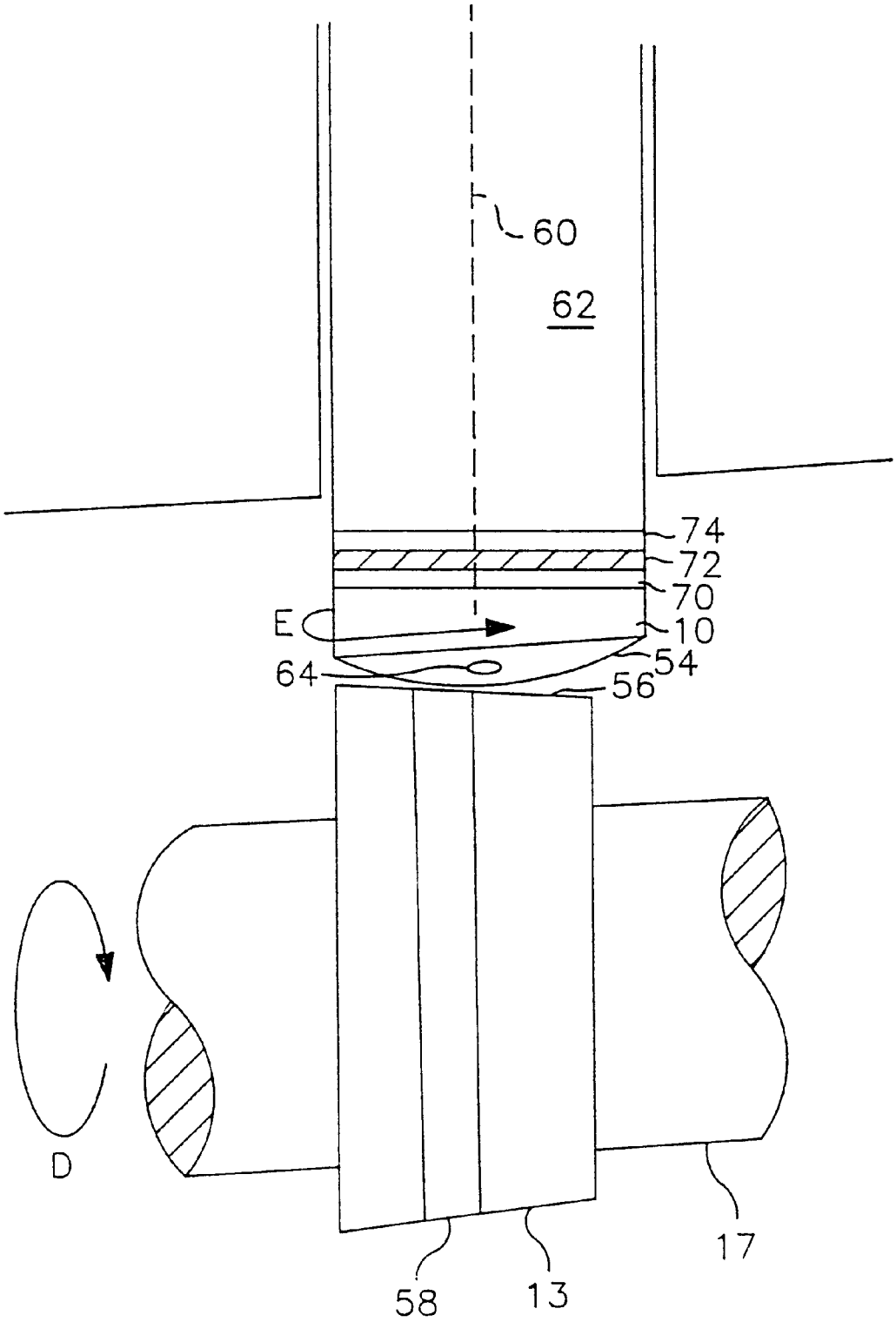
FIG. 4 is a fragmentary elevation view depicting the tappet as it appears in its bore, and showing the relationship between the tappet foot and the camshaft lobe.

FIG. 3 is a perspective view of a preferred embodiment of the improved tappet of the invention. The components identified in Section A of FIG. 3 is referred to below as the foot section of the tappet. The foot section includes an interchangeable foot 10, that (referring additionally to FIG. 4) comprises a convex hardened surface 54. In operation, the hardened surface 54 remains in contact with the tapered surface 56 at contact surface 58 (indicated by the dark circular track) of cam lobe 13 on cam shaft 17. The contact surface 58 is located off-center in relation to the center line 60 of interchangeable cam foot 10. This off set relationship causes the interchangeable foot 10 to axially rotate about the center line 60 of the tappet 62 (as indicated by the arrow E shown in FIG. 4) when cam 13 begins to rotate about its longitudinal axis (as indicated by the arrow D shown in FIG. 4). Because of the multi-piece design, foot 10 rotates separately from lifter body 62, as discussed in further detail below.

The independent axial rotation of the foot 10 relative to the lifter body 62 is an important improvement in the invention that helps to reduce the negative effects of friction. To further reduce frictional forces, a small hole 64 is drilled or otherwise formed through the center of foot 10 to allow the passage of oil to lubricate cam lobe 13. The foot 10 is interchangeable, thereby allowing custom applications that cover a wide variety of cam shaft designs and requirements. Specifically, another feature of the invention is the ability to design matched tappet foot 10 and cam lobe profiles 56 for specific applications. This is facilitated by allowing the replacement of one specific foot 10 with another having either a different diameter such as a mushroom tappet, or made of a different material in order to adapt to a variety of camshaft designs.

The foot 10 of the tappet includes a raised hub 66 that extends axially along the center line 60 from a flat bearing race surface 68. The axial hub 66 passes through a lower race 70, needle bearing 72, and upper race 74, and is slidably received into the bore 84 of a tappet bushing 76. The end of raised axial hub 66 contains a threaded hole 78 that receives retention screw 80. The retention screw 80 extends vertically downward through a retaining washer 82. The retaining washer 82 has a larger outer diameter than inside bore 84 of bushing 76. As will become clear below, retention screw 80 operates to hold the foot Section A to the remainder of the tappet 12 when it is installed and removed from the engine. During operation, retention screw 80 is not needed because the tappet 12 is held in place naturally between rotating cam lobe 10 and push rod 22.

The components included within Section B shown in FIG. 3 are collectively referred to as the bearing section of tappet 12, and includes a bottom race 70, a needle bearing 72, a top race 74 and a cam foot bushing 76. Each component is slidably received onto the raised axial hub 66 of foot 10 through their respective centers. The bottom race 70 is in direct contact with and is supported by the flat race surface 68 of the foot 10. The top race 74 is in direct contact with the lower flat surface 88 of the tappet body 62. In its preferred form, the top race 74 and bottom race 70 are both made from a hardened metal. The needle bearing 72 is positioned between the top race 74 and bottom race 70. Thus, the needle bearing 72 rotates between the top race 74 and bottom race 70. The cam bushing 76 is press fit into the axial bore 90 in the lower portion of the lifter body 62.

When the cam shaft 17 begins to rotate, the foot 10 also begins to axially rotate due to the relationship between the tapered surface 56 of the cam 13 and the convex cam surface 54 discussed above and shown in FIG. 4. The needle bearing assembly shown in Section B of FIG. 3 greatly reduces friction as the tappet foot 10 rotates. More specifically, instead of requiring to rotate the entire tappet assembly (including the elongated tappet body 62), the foot 10 rotates independently from the lifter body 62 separated by the bearing assembly B. Because the foot 10 is smaller and lighter than the entire tappet assembly, including the body 62, and further, rotates axially on the roller bearing assembly (70, 72 and 74), less friction is generated between the camshaft 17 and foot 10, thereby greatly increasing performance. Performance is even further increased as a result of the lubrication system (as discussed in greater detail below) and the interchangeable features of the tappet foot 10.

The components shown in Section C of FIG. 3 are referred to as the "lifter body portion," and comprises the main lifter body 62, the bushing 76, and the push rod cup 18. The lifter body 62 is a separate assembly from bearing Section B and foot Section A. It can therefore be made of a lighter-weight material than the foot section to still further reduce the forces of friction. The bottom of the lifter body contains axial bore 90 which receives cam foot bushing 76, typically in a press fit relationship. Approximately mid-way up the body 62 of the lifter is a radial grooved recess 94, which operates as an oil relief or lifter gallery. Depending on the application desired, oil orifice 96 can be drilled within the radial grooved recess 94, or slightly above it. If it is drilled within the radial groove 94 it functions as an inertia valve lifter. If the oil orifice is drilled lightly above the radial groove 94 it functions as an edge orifice lifter.

An inertia valve lifter receives oil from an oil gallery in the engine block through orifice 96. Once the oil is inside the lifter, an inertia activated, flapper-type, one way valve (not shown) forces the oil to travel up through a push rod orifice 102 and down through the foot orifice 64. In essence, the lifter actually acts as a miniature oil pump and provides more oil pressure and volume to the upper valve train. The oil port 96 on an edge orifice lifter (as discussed above) is located slightly above the radial grooved recess 94. In an edge orifice lifter, the oil from the supply gallery enters the lifter through small orifice 96 in much the same way as in the inertia valve lifter. However, additional oil passes around the lifter and down to subsequent lifters in the lifter bank. Because the orifice is located high on the lifter body, it is not exposed to the high pressure in the lifter gallery, and the amount of oil admitted is restricted by the clearance between the lifter bore and the lifter. Because of that fact, an edge orifice lifter typically delivers approximately 20% less oil to the top end of the engine than an inertia-valve lifter. In both types of lifters, once oil enters the lifter body, it flows upward through the lifter body 62, around intermediate spacer 98, through an oil port 100 formed in the bottom of the push rod receiver cup 18 through bored push rod oil channel 102 formed in the bottom of the push rod 22, and through the push rod oil channel 102 to the top end of the engine. The present invention is compatible and functions equally well with either an inertia-valve lifter or an edge-orifice lifter because interchangeable foot 10 can be used with either type of lifter. Therefore, the invention is not restricted to only one type of mechanical tappet.

If additional lubrication is desired between the tapered cam surface 56 and convex hardened surface 54, the present invention provides a lubrication port 64 located at the center foot 10. Oil can then flow through to oil port 64 via hole 81 drilled through retention screw 80.

The intermediate spacer 98 is slidably received into the top of the lifter body 62, and rests on a radial edge 104 machined or otherwise formed in the inside of the lifter body 62. The spacer 98 contains a laterally grooved channel 106 located on its top surface of the intermediate spacer 98. The diameter of intermediate spacer 98 is slightly smaller than inside diameter 108 of the lifter body, thereby allowing lubricating oil to flow around the spacer 98 into the grooved channel 106, through orifice 100 in the push rod receiver cup 18, through push rod orifice 102, and into push rod 22, eventually reaching the top of the engine valve train.

Figure 3A:
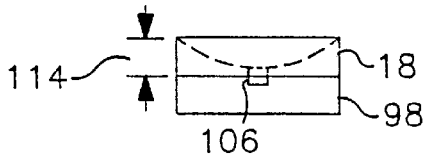
FIG. 3A is a sectional side view of an intermediate spacer and interchangeable push rod receiver cup used with the present invention.

Also slidably received into the top of lifter body 62 is an interchangeable push rod receiver cup 18. The bottom surface of push rod receiver cup 18 is in direct contact with the top surface of intermediate spacer 98, thus creating channel 106 (see FIG. 3A) through which lubrication oil flows. Snap ring 110 is received into a radial groove (not shown) formed on the inside surface of the lifter body 62, thereby holding intermediate spacer 98 and push rod receiver cup 18 within lifter body 62. Thus, another advantage of the invention is the use of a separate push rod receiver cup 18, thereby allowing the selection from among cups of different thickness to be installed for the purpose of changing the overall push rod length if desired.

As discussed above, FIG. 4 depicts a fragmentary elevation side view of the assembled device in operation. Tappet or lifter foot 10 is shown in contact with tapered cam surface 56. As tapered cam lobe surface 56 rotates in direction of arrow D as driven by a cam chain or gear (not shown), the lifter foot 10 rotates axially about the center line of the lifter body 62, as shown by the direction of arrow E. The rotation of the foot 10 is completely independent from lifter body 62. This independent rotation is made possible because of the off center orientation between hardened convex surface 54 and tapered cam surface 56, and the bearing assembly. It should be understood from FIG. 4 that the principles of the invention apply equally to any form of tappet, including a bucket-type, hydraulic, or other form of tappet, as long as the foot is allowed to rotate separately from the tappet body at the interface with the cam lobe. In the application of the invention for a bucket-type tappet, the tappet is inverted on a valve spring so that the rotating foot contacts the lobe of an overhead cam.

Figure 5:
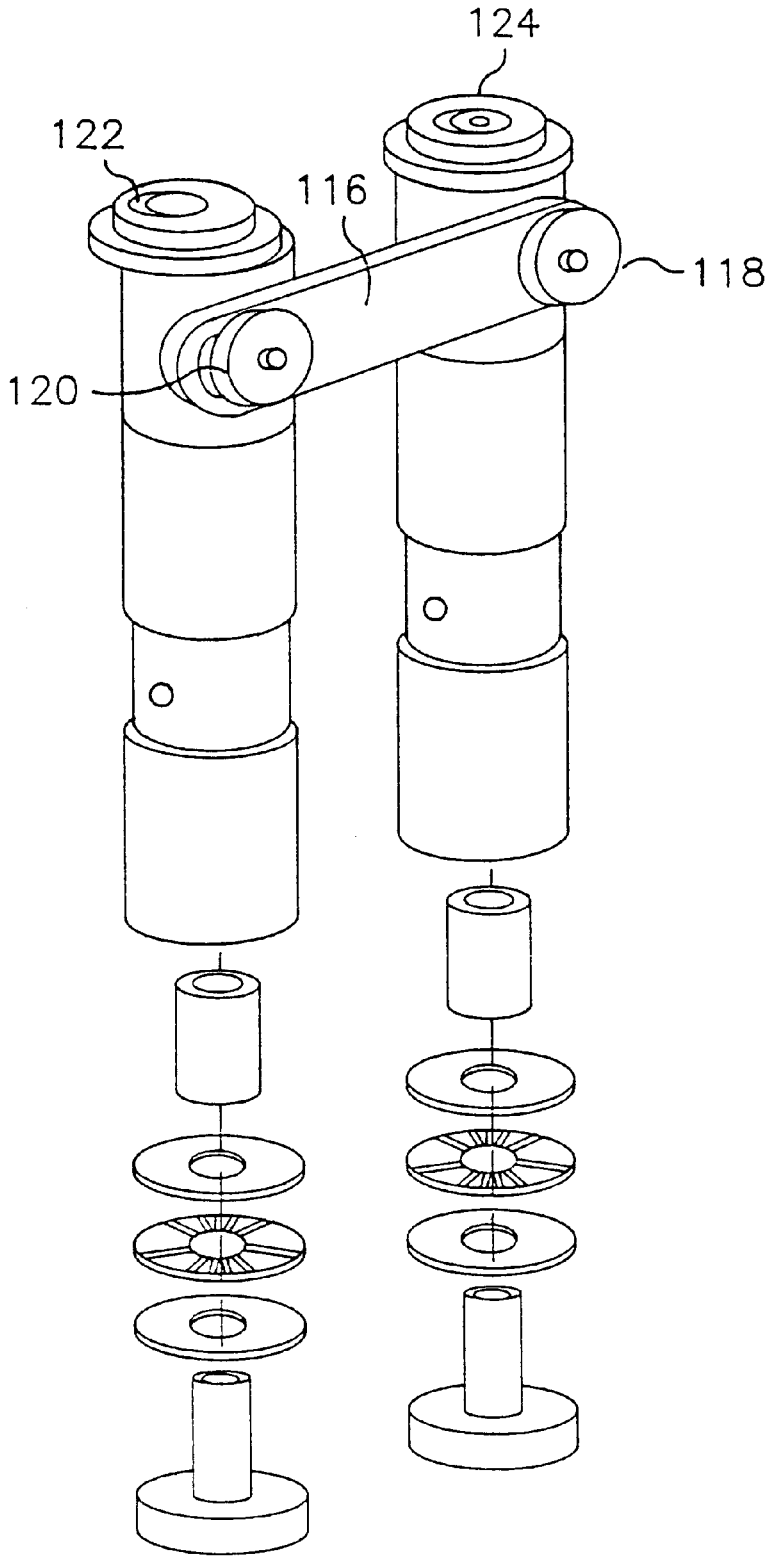
FIG. 5 is an assembly view of another embodiment of the device in which an off-set push rod cup and anti-rotational strap are used.

FIG. 5 represents alternative embodiment of the preferred device. It is similar to the embodiment shown in FIG. 3, but is modified in order to use high seat, offset push rod cup 122, or a Rev Kit (not shown). In some engine configurations (especially configurations in which the intake ports have been bored larger) it is desirable, if not necessary, to have an offset push rod receiver cup 122 to prevent the push rod from contacting the engine block as it moves up and down. Thus, in this modified form of the invention, push rod receiver cup 122 must retain the same orientation with respect to the engine manifold. The lifters must therefore incorporate an anti-rotational device. In order to prevent the lifters from rotating, an anti-twist link bar 116 is attached to consecutive lifter bodies by retainer screws 118 and 120 into respective threaded holes, thereby preventing the pair of lifters from rotating. One anti-rotation strap is necessary for each pair of lifters.

Figure 6:
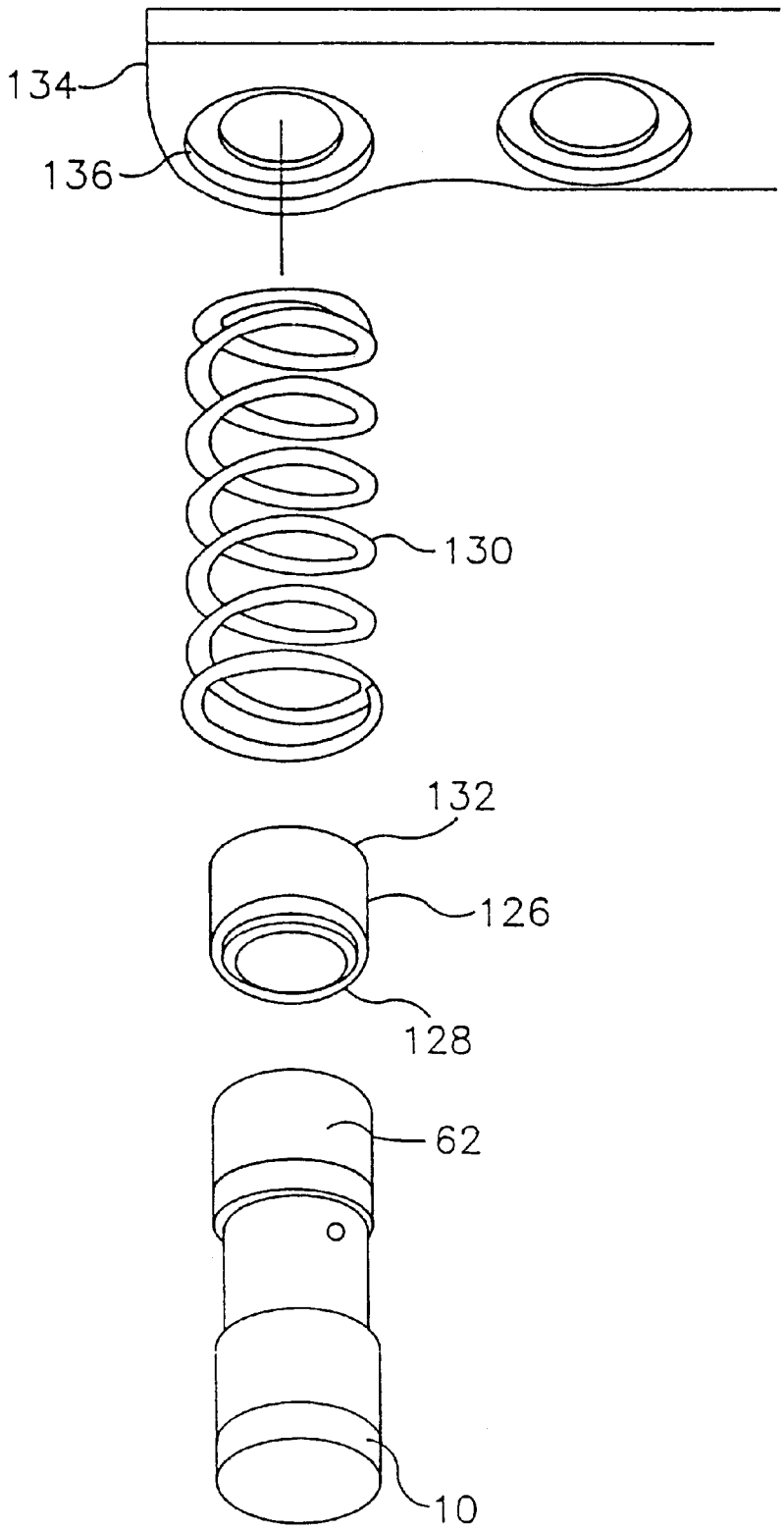
FIG. 6 is an assembly view of another embodiment of the invention employing a "Rev Kit".

FIG. 6 depicts still another embodiment of the invention that employs a Rev Kit. A Rev Kit functions as a counter spring and maintains a constant downward force on the lifter body to help keep the foot 10 in contact with the tapered cam surface 56 of cam 13. This is particularly beneficial in high-rpm applications. In the embodiment depicted in FIG. 6, radial lip 128 of adapter 126 is slidably received into the top of lifter body 62. Counter spring 130 is likewise received into a radial groove 132 machined into the top of adapter 126. Spring holder 134 is positioned in such a way so as to receive the top of compression spring 130 into a machined radial groove 136. Push rod 22 is then received through spring holder 134, counter spring 130, adapter 126, and into push rod receiver cup 18 on top of lifter body 62.

Figure 7:
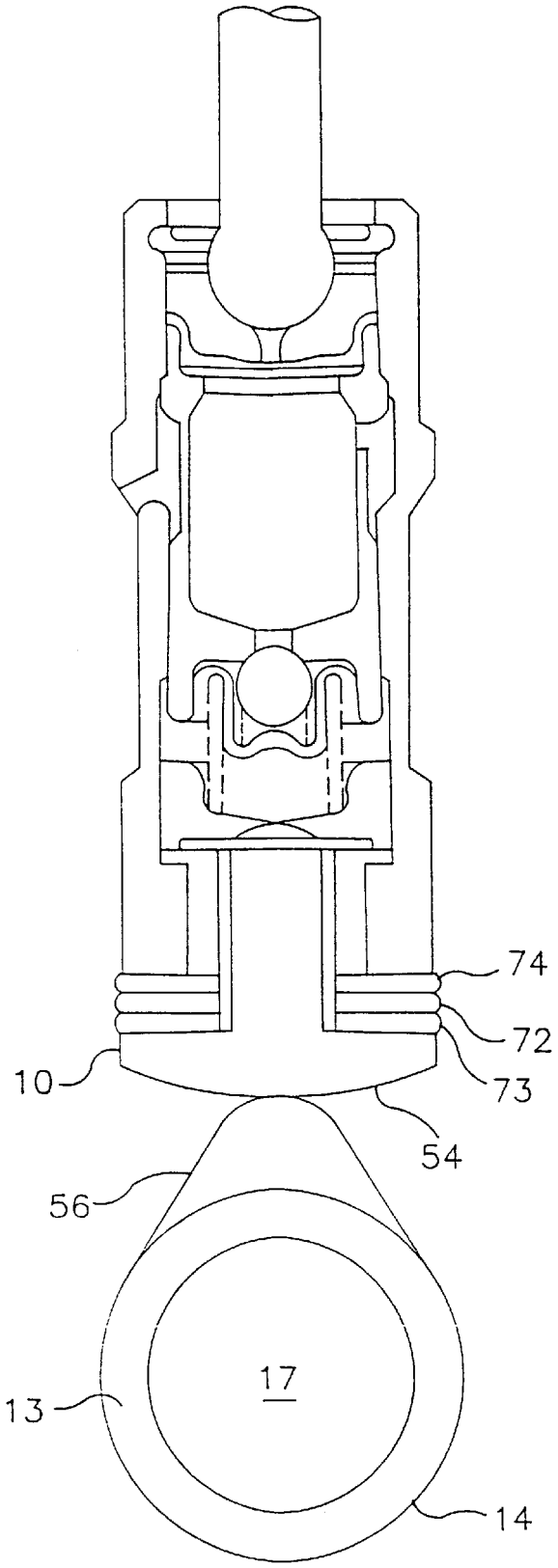
FIG. 7 is a cut away side view of another embodiment of the device as it appears in use with a hydraulic lifter.
Figure 8:
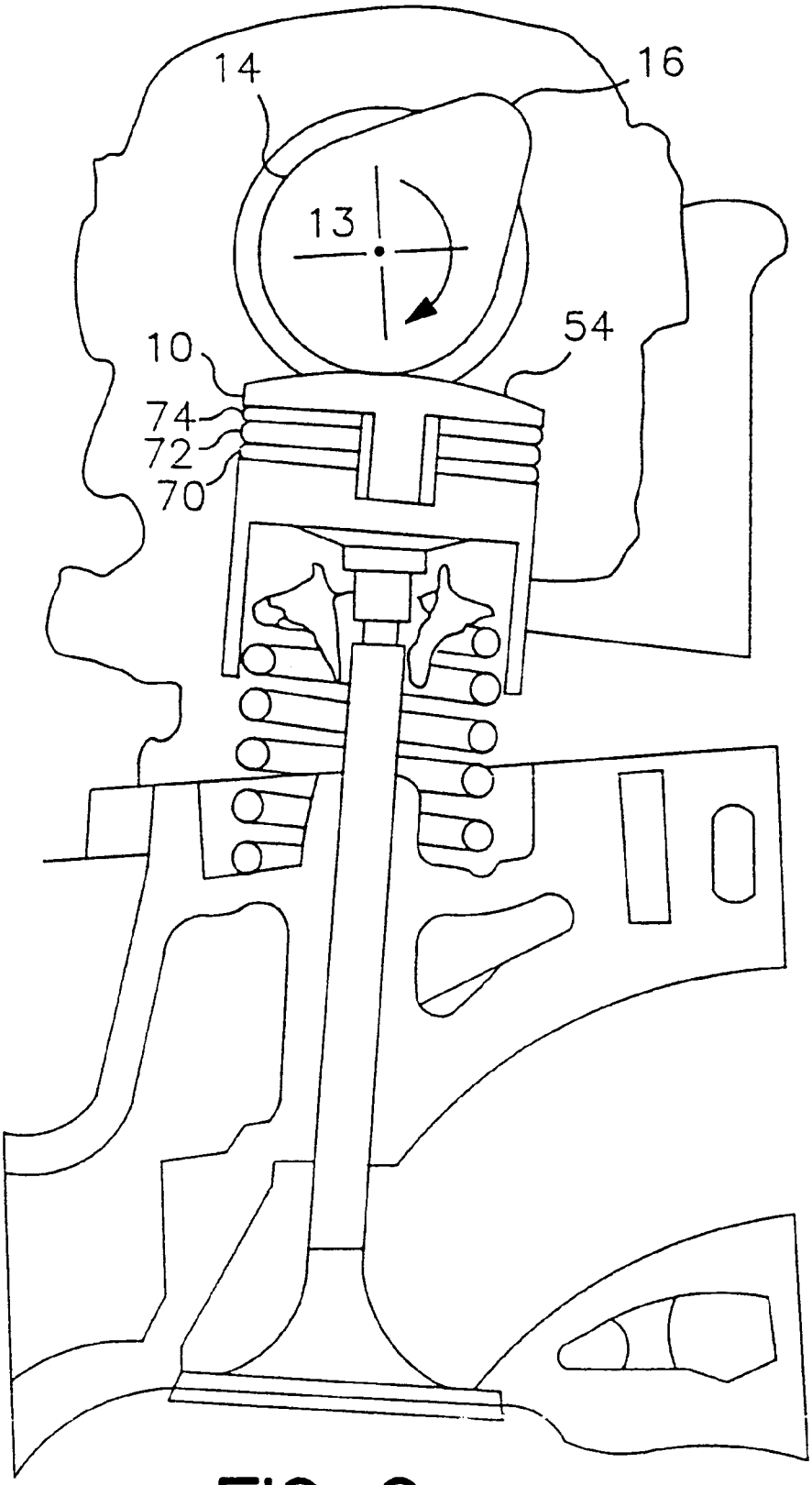
FIG. 8 is a cut away side view of another embodiment of the invention as it appears in use with an overhead direct acting bucket tappet.

Shown in simplified schematic form in FIG. 7 is a modified form of the invention as employed in a hydraulic tappet. Shown in simplified schematic form in FIG. 8 is yet another modified form of the invention as applied to a bucket tappet for use with an overhead cam. In each of these Figures, like numerals indicate like parts as shown in the earlier Figures. Specifically, in each of these modified embodiments, the foot 10 rotates on needle bearing 72 about the center line of the tappet body, as induced by friction between the tapered cam surface 56 of the cam 13.

In its preferred form, the disclosed tappet device offers many improvements over the prior art. For example, because of its multiple-piece design, friction is greatly reduced between the lifter foot and the cam lobe because only the lifter foot is rotating. Also, the preferred device may be used effectively with cam shafts having steep opening and closing flank angles necessary in high performance applications. Also due to the decreased friction, operating engine oil temperatures will be significantly reduced. In addition, because of the multiple piece design, a lighter weight lifter body can be used with a hardened lifter foot. The preferred form of the device also allows for interchangeable push rod receiver cups of different thicknesses so push rods need not be changed to alter their length, only the push rod receiver cup. Further, lubrication to the cam lobes and cam shaft will be increased because of the drilled through hole on the lifter foot. Also, the device in its preferred form can be used in all racing classes in addition to any and all stock applications. Still other advantages will be readily apparent to those who use the device. As mentioned above, the invention can be employed on any form of tappet, including mechanical, mushroom, hydraulic and bucket type tappets.

What is claimed is:

1. A method of constructing a tappet including the acts of:

forming a foot having a cam contact surface and an axially extending hub;

forming a tappet body having a lower body portion with a lower axial bore formed therein to accept the axially extending hub of the foot;

providing a bearing assembly between the foot and the lower portion of the tappet body to reduce friction as the foot separately rotates axially about a center line of the tappet body;

inserting the axially extending foot into the lower body portion of the tappet body whereby the bearing assembly is located between the foot and the tappet body.

2. The method of claim 1 further comprising forming a convex surface on the surface of the cam contact surface.

3. The method of claim 1 wherein the foot includes a top flat surface formed to support the lower bearing race, and the lower portion of the tappet body includes a lower flat surface formed to contact the upper bearing race.

4. The method of claim 2 further including the act of forming an oil delivery system including an oil path leading from the tappet body to the convex cam contact surface.

5. The method of claim 4 further includes:

forming an oil access orifice in the mid-section of the tappet body at a location selected to mate with a source of oil, and leading the oil access orifice to an interior chamber of the tappet body;

forming an oil orifice in the convex surface of the foot; and forming a bore in the center of the axially extending hub of the foot, and forming a channel between the interior chamber of the tappet body and the oil orifice in the convex surface of the foot.

6. The method of claim 1 further comprising the acts of:

positioning the cam contact surface in a frictional relationship with a cam lobe of a rotating cam, and inducing the foot to rotate about the center line of the tappet through the frictional relationship between the cam lobe and the cam contact surface of the foot.

7. The method of claim 1 further comprising the act of providing a foot removable from the lower bore in the tappet body.

8. The method of claim 1 further comprising forming the bearing assembly as a needle bearing.

9. The method of claim 1 further comprising the acts of:

forming the bearing assembly with a lower race, an upper race, and a needle bearing;

placing the needle bearing between the lower race and the upper race, wherein the bearing assembly reduces friction between the rotating foot and the tappet body.

10. The method of claim 1 further comprising positioning a replaceable push rod receiver cup assembly on a top portion of the tappet body.

11. The method of claim 1 further comprising forming the tappet as a mechanical tappet.

12. The method of claim 1 further comprising forming the tappet as a hydraulic tappet.

13. The method of claim 1 further comprising forming the tappet as a bucket tappet.

14. The invention in accordance with claim 1 wherein the top portion of the tappet body includes an upper axial bore and a support shelf formed within the bore, and wherein the replaceable push rod receiver cup assembly is supported on the support shelf within the bore in the top portion of the tappet body.

15. A method of increasing the performance of an engine having cam actuated valves including the acts of:

forming a tappet body having a lower body portion with a lower axial bore formed therein;

forming a foot having a cam contact surface and an axially extending hub, the hub of the foot being inserted into the axial bore of the lower body portion of the tappet body;

providing a bearing assembly between the foot and the lower portion of the tappet body to reduce friction as the foot rotates axially about a center line of the tappet body;

installing a set of tappets having the foot and the bearing assembly in the engine.

16. The method of claim 15 further comprising the acts of:

positioning the cam contact surface in a frictional relationship with a cam lobe of a rotating cam, and inducing the foot to rotate about the center line of the tappet through the frictional relationship between the cam lobe and the cam contact surface of the foot.

17. A replacement tappet for replacing a tappet in an engine, the replacement tappet comprising:

a foot having a cam contact surface;

a tappet body having a lower body portion formed to receive the foot; and a bearing assembly positioned between the foot and the lower portion of the tappet body, the bearing assembly operating to reduce friction as the foot separately rotates axially about a center line of the tappet body.

18. The invention in accordance with claim 17 further comprising a foot removable from the lower bore in the tappet body.

19. The invention in accordance with claim 18 wherein the foot further comprises an axially extending hub and the lower portion of the tappet body comprises an axial bore to accept the axially extending hub of the foot.

20. The invention in accordance with claim 17 wherein the bearing assembly comprises a lower race, an upper race, and a needle bearing placed between the lower race and the upper race, and wherein the bearing assembly reduces friction between the rotating foot and the tappet body.

21. The method of claim 20 wherein the foot includes a surface formed to support the lower bearing race, and the lower portion of the tappet body includes a lower surface formed to contact the upper bearing race.

* * * * *